US007673863B2

(12) United States Patent
Iguchi

(10) Patent No.: US 7,673,863 B2
(45) Date of Patent: Mar. 9, 2010

(54) SHEET POST-PROCESSING APPARATUS

(75) Inventor: Ken Iguchi, Sunto-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 542 days.

(21) Appl. No.: 11/615,363

(22) Filed: Dec. 22, 2006

(65) Prior Publication Data

US 2008/0150211 A1 Jun. 26, 2008

(51) Int. Cl.
*B65H 37/04* (2006.01)

(52) U.S. Cl. ..... 270/37; 270/32; 270/45; 270/46; 270/51; 270/58.07; 270/59

(58) Field of Classification Search ..... 270/32, 270/37, 45, 46, 51, 58.07, 59; 493/434, 435, 493/442, 443, 444, 445
See application file for complete search history.

(56) References Cited

U.S. PATENT DOCUMENTS 6,003,853 A * 12/1999 Nakazawa et al. ..... 270/58.11
6,090,032 A * 7/2000 Bellanca ..... 493/423

FOREIGN PATENT DOCUMENTS

| | | | |
|---|---|---|---|
| JP | 7-157102 | | 6/1995 |
| JP | 2004189421 A | * | 7/2004 |
| JP | 2005-008418 | | 1/2005 |
| JP | 2007076832 A | * | 3/2007 |

* cited by examiner

*Primary Examiner*—Gene Crawford
*Assistant Examiner*—Leslie A Nicholson, III
(74) *Attorney, Agent, or Firm*—Turocy & Watson, LLP

(57) ABSTRACT

In a sheet post-processing apparatus to perform a folding processing to a sheet bundle, a folding roller drive motor to drive a pair of folding rollers is PWM driven, and its speed is changed according to the sheet type or sheet size and between a period before a blade comes in contact with the sheet bundle, a period when the blade is being inserted between the folding rollers after coming in contact with the sheet bundle, and a period when folding is being performed by the folding rollers.

5 Claims, 7 Drawing Sheets

SHEET POST-PROCESSING APPARATUS

BACKGROUND OF THE INVENTION

1. Field of the Invention

The present invention relates to a sheet post-processing apparatus provided with a function of saddle stitch operation or folding processing, and particularly to a sheet post-processing apparatus capable of realizing high accuracy folding processing.

2. Description of the Related Art

There is developed a sheet post-processing apparatus having a bookbinding function for binding plural sheets, on which images have been formed, by staples. Binding methods performed in the sheet post-processing apparatus as stated above include end stitch of stitching a sheet bundle at one place or plural places on the end side thereof, and saddle stitch of stitching a sheet bundle at plural places of the center part thereof. Some apparatus to perform the saddle stitch has a saddle stitch folding function to fold the center part of the stitched sheet bundle to form something like a weekly magazine.

In the saddle stitch folding function to fold the center part of the stitched sheet bundle to form something like the weekly magazine, folding means at the center part includes a blade and a pair of folding rollers (for example, see JP-A-2005-8418).

This is such that the folding means at the center part of the sheet bundle pushes the center part of the transported sheet bundle into the facing part of the pair of folding rollers by the blade, and the folding processing is performed to the sheet bundle by pressurization due to the rotation of the folding rollers.

The sheet bundle subjected to the folding processing is discharged from the folding rollers, is transported along a transport path, and is accumulated on a saddle tray.

Since it is necessary that the folding rollers fold the sheet bundle with high accuracy, low speed rotation at a constant speed is generally used. However, although the folding accuracy of the sheet bundle varies according to the sheet type, such as thick paper, waterproof paper or color print paper, or the sheet size, the folding accuracy corresponding to each of them can not be obtained by the low speed rotation at the constant speed.

Besides, in the case where high speed rotation at a constant speed is performed, the body of folding of the sheet bundle is not satisfactorily obtained, and there occurs a disadvantage that the sheet bundle is expanded after being folded.

Besides, also with respect to the drive speed of the blade to push the sheet bundle into between the folding rollers, a constant speed is used. In this case, when the blade is driven at a high speed, even if an adjustment is made so that the blade comes in contact with the center of the sheet bundle, a shift occurs immediately after the instant when the blade comes in contact with the sheet bundle.

On the other hand, in the case where the blade is driven at a low speed, a load is applied to the blade at the folding, and a very high force is required. Thus, a powerful driving source is required.

BRIEF SUMMARY OF THE INVENTION

It is an object of the present invention to provide a sheet post-processing apparatus including a folding roller driving motor to drive a pair of folding rollers for folding a sheet bundle In an aspect of the present invention, a sheet post-processing apparatus includes stitch processing means for stitching a sheet bundle transported through a transport path at plural places along a straight line orthogonal to a transport direction with staples, folding means provided with a pair of folding rollers disposed at a later stage of the transport path with respect to the stitch processing means and a blade to push the sheet bundle into a contact part of the pair of folding rollers, a folding roller drive motor to drive the pair of folding rollers, and control means for acquiring sheet type information of the sheet bundle and for controlling a drive or stop operation of the folding roller drive motor according to a folding processing step of the sheet bundle, in which the control means changes a speed of the folding roller drive motor according to the sheet type and between a period before the blade comes in contact with the sheet bundle, a period when the sheet bundle after folding work is being transported to a discharge port, a period when the sheet bundle is being discharged, and a period when the folding roller drive motor is being returned to a home position.

DETAILED DESCRIPTION OF THE INVENTION

Throughout this description, the embodiments and examples shown should be considered as exemplars, rather than limitations on the apparatus and methods of the present invention.

Hereinafter, the best mode for carrying out the invention will be described in detail with reference to the drawings.

Figure 1:
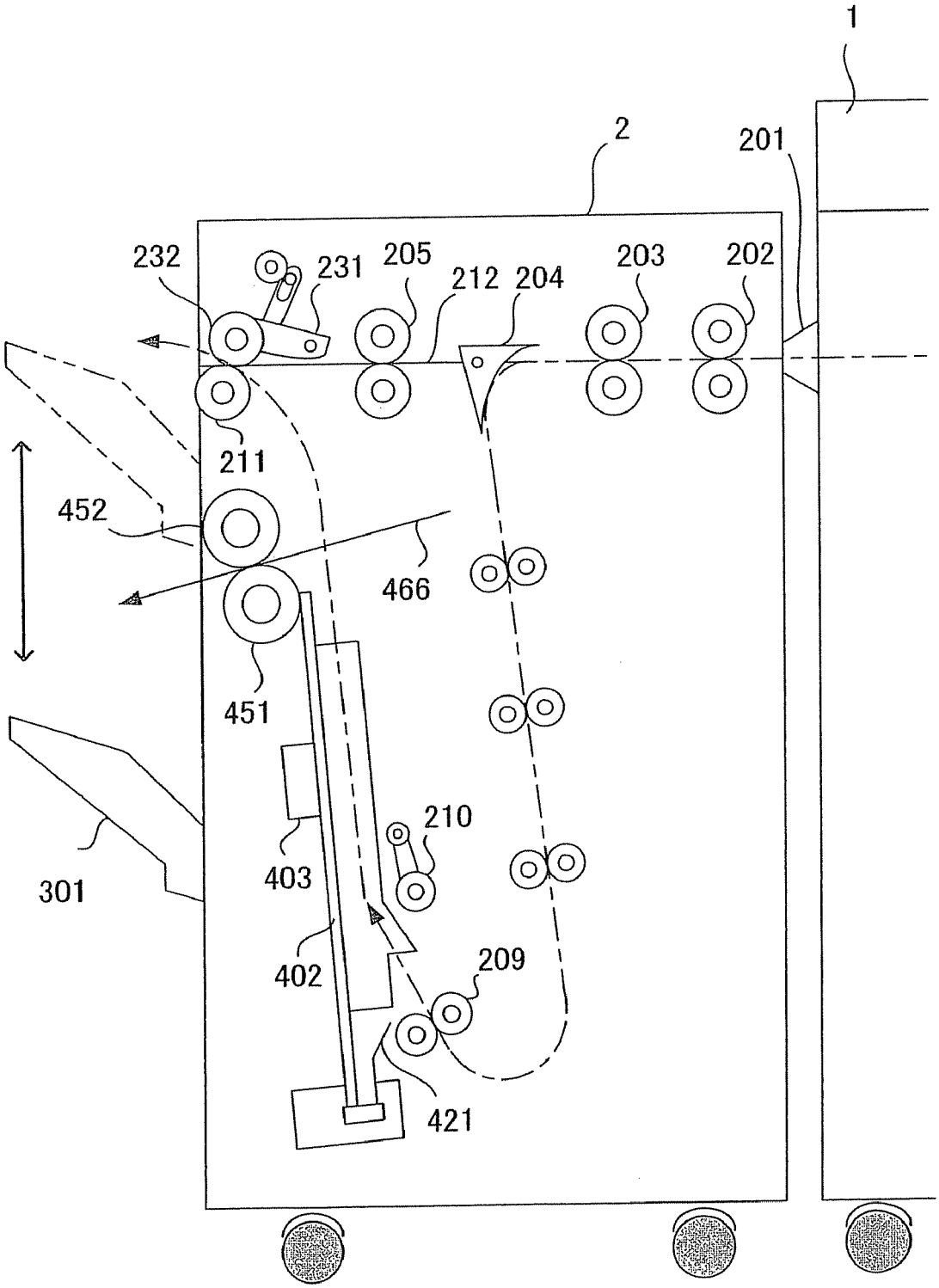
FIG. 1 is a schematic sectional view of a sheet post-processing apparatus as the best mode for carrying out the invention.

FIG. 1 is a schematic sectional view of a sheet post-processing apparatus 2 as the best mode for carrying out the invention. This sheet post-processing apparatus 2 has a simple bookbinding function in which sheets with images formed by an image forming apparatus 1 are received, a staple process is performed, and a sheet bundle SP subjected to the staple processing is folded.

As shown in FIG. 1, the sheet post-processing apparatus 2 includes, along a transport path through which the sheet bundle SP is transported, an entrance guide plate 201, feed rollers 202 and 203, a branching pawl 204, a discharge feed roller 205, a staple tray 402, a staple tray feed roller 209, a paddle 210, a sheet rear end receiver 421, a saddle stitch stapler 403, transport rollers 211 and 232, a paper discharge guide plate 231, a blade (staple contact member) 466, folding rollers 451 and 452, and a paper discharge tray 301.

First, the outline of the operation in the sheet post-processing apparatus 2 after receiving a sheet from the image forming apparatus 1 will be described. The sheet discharged from the image forming apparatus 1 is guided to the transport path in the apparatus by the entrance guide plate 201, and the sheet is transported by the feed rollers 202 and 203 and is sent to one of a transport path for discharging and a transport path for staple processing by the branching pawl 204.

In the case where the transport path for the staple processing is selected, the sheet is sent to the staple tray 402 by the staple tray feed roller 209, and here, the sheet is dropped one by one by the paddle 210 to a lower part of the staple tray 402. The sheets dropped by the paddle 210 are received by the sheet rear end receiver 421, and the sheet rear ends are aligned. The alignment of the sheets in the width direction (direction orthogonal to the sheet transport direction) is performed by a not-shown lateral alignment plate. At this time, in a state where saddle stitch of a staple mode is selected, the transport roller 232 is at a position separate from the transport roller 211 by rotation of the paper discharge guide plate 231.

Besides, in the case of the saddle stitch operation, after the final sheet is aligned, the saddle stitch operation is performed to the sheet bundle SP at two positions by the two saddle stitch staplers 403 provided to be spaced from each other by a specified interval in the horizontal direction. The stitch position is on a line which becomes the center of the sheet in the same direction as the sheet transport direction.

The sheet bundle SP is raised upward by a not-shown bundle sending belt, and is stopped when the position of the needle stitched by the saddle stitch stapler 403 reaches a specified position.

Figure 2:
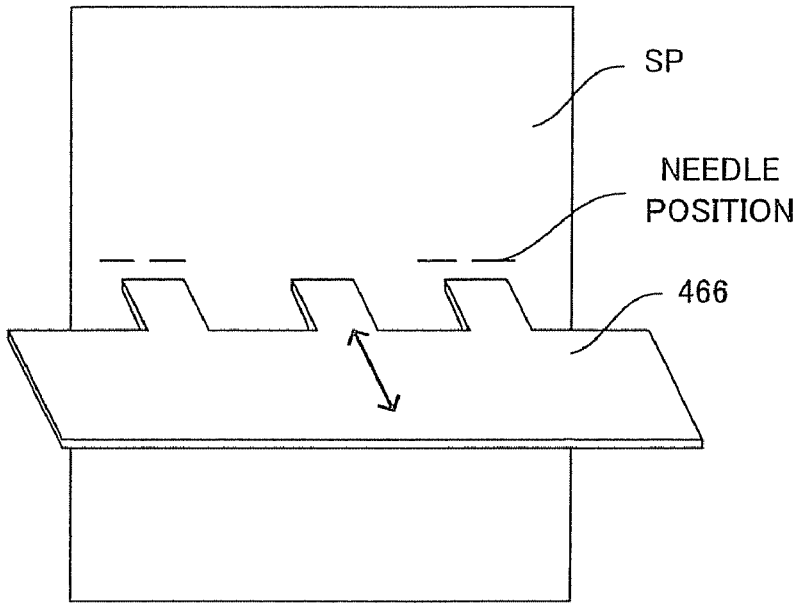
FIG. 2 is a perspective view showing a positional relation between a sheet bundle and a blade at a time when the sheet bundle stops at a specified position.

FIG. 2 is a perspective view showing a positional relation between the sheet bundle SP and the blade 466 at this time. In the transport operation by the bundle sending belt, as shown in the drawing, the blade 466 is on standby at a position separate from the sheet bundle SP.

Figure 3:
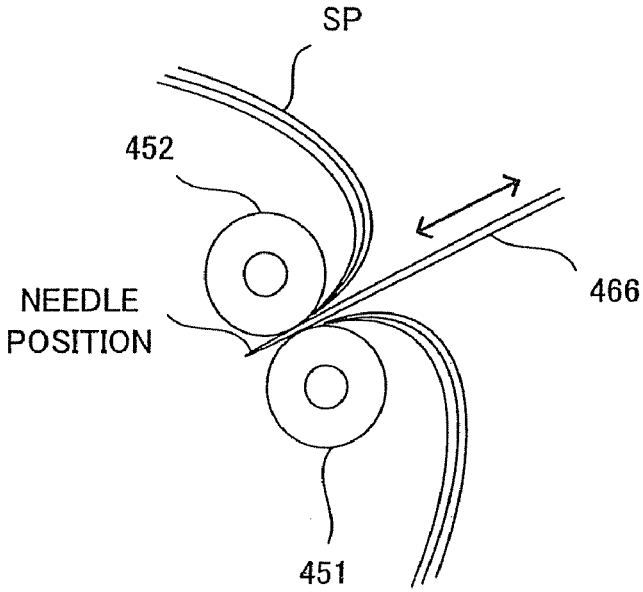
FIG. 3 is a side view at a time when a folding processing is performed to the sheet bundle in the sheet post-processing apparatus of the invention.

Thereafter, an after-mentioned operation by the periphery of the transport rollers 211 and 232 and the blade 466 is performed to the sheet bundle SP, and the center portion of the sheet bundle SP is pushed into between the folding rollers 451 and 452 by the blade 466 as shown in FIG. 3. After the simple bookbinding processing is performed in this way, the sheet bundle SP is discharged to the paper discharge tray 301.

On the other hand, in the case where the transport path for discharging is selected as the transport destination of the sheet received from the image forming apparatus 1, the sheet is made to flow to the discharge feed roller 205 side by the branching pawl 204, is sent to the transport rollers 211 and 232 by the transport force of the discharge feed roller 205, and is discharged to the paper discharge tray 301 as it is. Incidentally, the operation of each unit in the sheet post-processing apparatus 2 is controlled by not-shown control means (CPU) based on an instruction input from a user.

Figure 4:
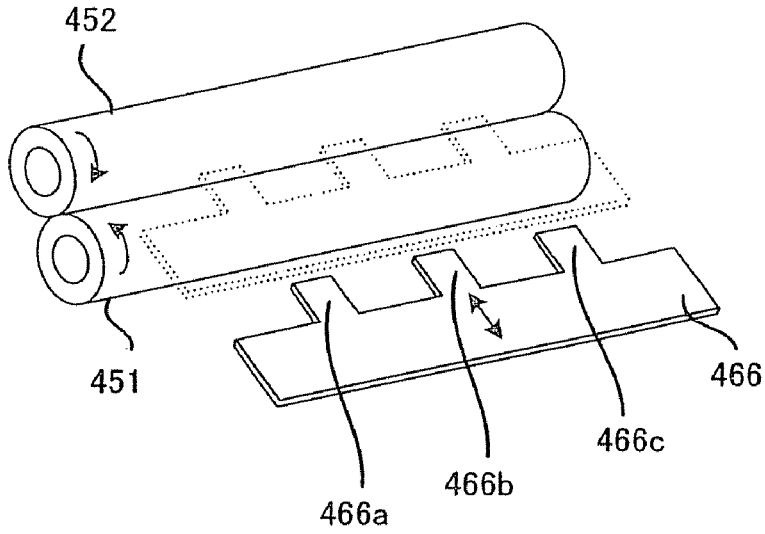
FIG. 4 is a perspective view showing a relation between a blade for performing a folding processing and folding rollers in the sheet post-processing apparatus of the invention.
Figure 5:
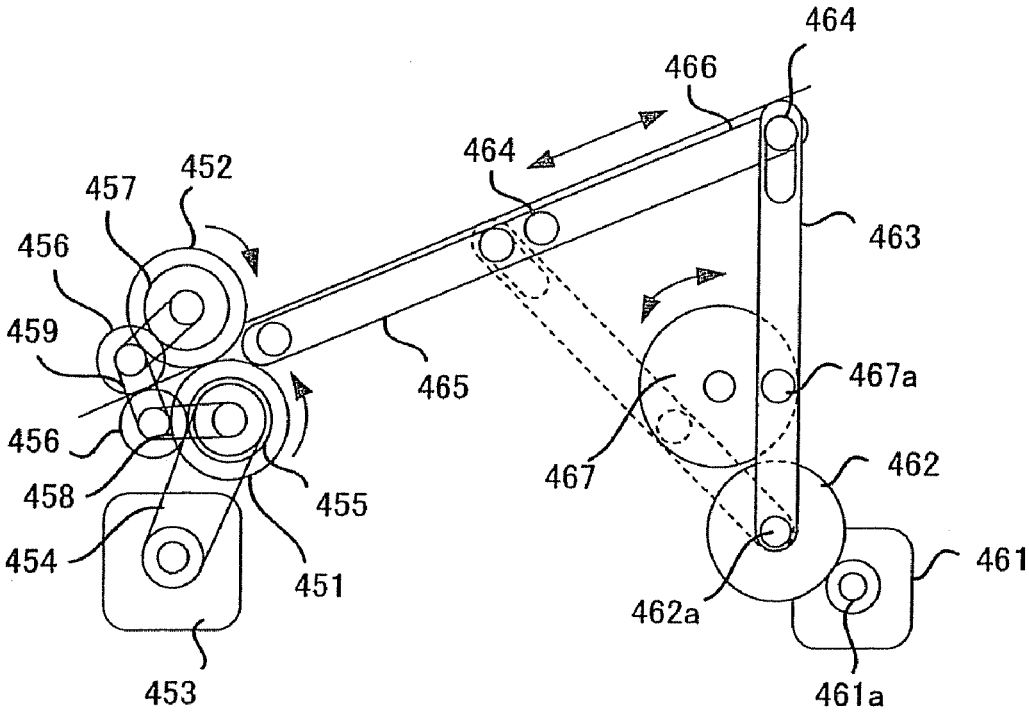
FIG. 5 is a side view of a mechanism for driving the blade in the sheet post-processing apparatus of the invention.

Next, the structure of a folding processing unit will be described. FIG. 4 is a perspective view of the blade 466 and the folding rollers 451 and 452 for performing the folding processing, and FIG. 5 is a side view of a mechanism for driving the blade 466. In the thin plate-like blade 466, a shaft part 464 integrated at its lower surface is fitted in a guide groove (guide slit) 465 and is provided to be movable in an arrow direction along the guide groove 465, the rotation driving from an output gear 461*a* of a blade drive motor 461 is transmitted to a cam 467 through an intermediate gear 462, and the cam is rotated forward and reverse. One end of a link 463 is rotatably supported by a shaft part 462*a* of the intermediate gear 462, and one shaft part 464 is loosely fitted in a long hole provided in the other end. A pin 467*a* provided on the cam 467 is axially supported at an intermediate part of the link 463, the link 463 is swung between a solid line position and a dotted line position by the forward and reverse rotation of the cam 467, and by that, the blade 466 is linearly reciprocated in an arrow direction.

Besides, the blade 466 is provided with protrusions 466*a*, 466*b* and 466*c* at its edge part, and the protrusions 466*a* and 466*c* are provided at the same positions as needle positions of the saddle stitch stapler 403. The protrusion 466*b* is provided at the center part of the two needle positions of the saddle stitch stapler 403. The three protrusions 466*a*, 466*b* and 466*c* are provided because, in the case where two protrusions are provided in the blade 466, when the sheet bundle SP is pressed to the folding rollers 451 and 452, the center part of the sheet bundle SP is no completely pressed and is warped, and wrinkles are produced at the center part in the folded state, and this must be dealt with.

The folding rollers 451 and 452 have such a structure that both sides are rotation-driven by driving of a folding roller drive motor 453 and by driving of a drive gear pulley 455, an intermediate gear 456 and a driven gear 457 through a timing belt 454. The drive gear pulley 455, the intermediate gear 456 and the driven gear 457 are coupled by arms 458 and 459, and the mutual relative position can be moved while intervals between the respective shafts are kept. By this, even in the state where the sheet bundle SP is nipped between the folding rollers 451 and 452 and the rollers are separated from each other, the rotation driving can be certainly transmitted to both the folding rollers 451 and 452. Besides, the folding rollers 451 and 452 are mutually press contact with each other by a tension spring (not shown).

The protrusions 466*a*, 466*b* and 466*c* of the edge of the blade 466 press the stapled needle positions of the sheet bundle SP, and advance to the position where they are overlapped with the nip position of the folding rollers 451 and 452, and the folding processing is performed to the center part of the sheet bundle SP by the press contact and rotation of the folding rollers 451 and 452.

As the folding roller drive motor 453, a well-known brushless DC motor can be used. In the brushless DC motor used, the rotation angle of a permanent magnet rotator is detected by an encoder, and an exciting current (armature current) supplied to an armature winding of a stator is switched to form a rotation magnetic field in the stator, so that the rotator is rotated.

The control uses a voltage type PWM inverter (control means) in which the exciting current of the armature winding is PWM (Pulse Width Modulation) controlled at a duty (on time/(on time+off time)) corresponding to a torque instruction indicating a target output.

In this voltage type PWM inverter, plural switching elements (for example, power MOSFET) constituting abridge circuit are on and off controlled by a bootstrap drive circuit (gate circuit). The bootstrap drive circuit includes a bootstrap capacitor for supplying drive current (gate current) charged with a specified voltage, and at the on time of the PWM control signal of the duty corresponding to the torque instruction, the drive current (gate current) is sent from this capacitor to the control end (gate) of the switching element to turn on this switching element, whereas at the off time of the PWM control signal, the drive current is made to flow in the opposite direction, and this switching element is turned off.

Next, a description will be given to embodiments relating to the control of the folding roller drive motor 453 to drive the folding rollers and the blade drive motor 461 with respect to a series of processings at this folding processing.

Embodiment 1

In this embodiment 1, the folding roller drive motor 453 is controlled according to the type of the sheet.

Figure 6:
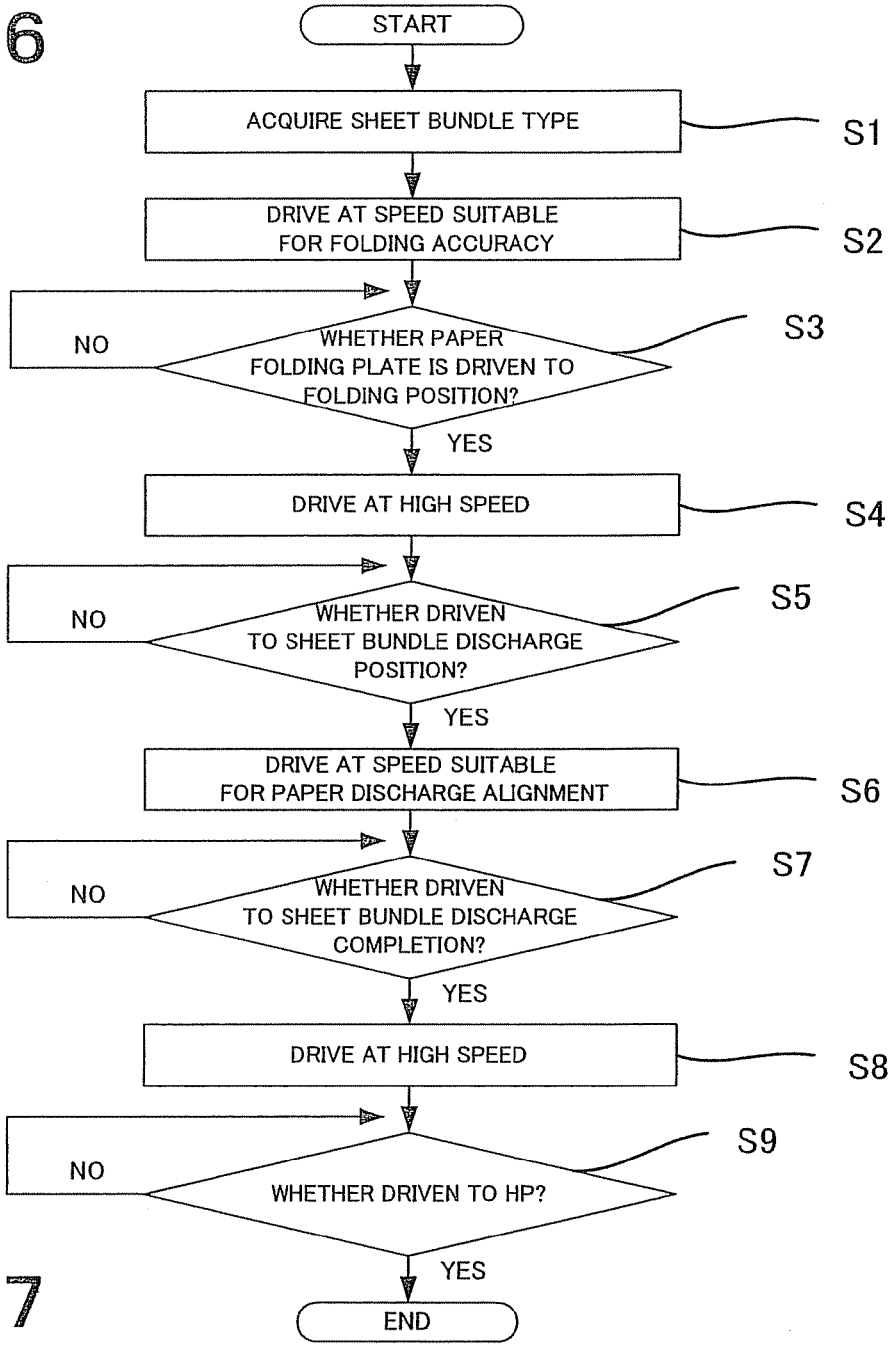
FIG. 6 is a flowchart of control of a folding roller drive motor in a sheet post-processing apparatus of embodiment 1 of the invention.
Figure 7:
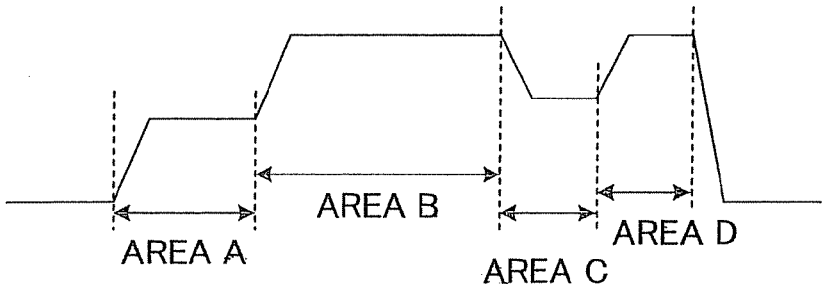
FIG. 7 is a timing chart of the folding roller drive motor in the sheet post-processing apparatus of the embodiment 1 of the invention.

FIG. 6 is a flowchart of control by the PWM driving of the folding roller drive motor 453, and FIG. 7 shows a timing when the rotation speed is changed by changing a duty while the folding roller drive motor 453 is PWM driven.

Since the folding rollers 451 and 452 are driven by the folding roller drive motor 453, they receive the rotation control corresponding to the PWM driving of the folding roller drive motor 453.

First, sheet type information on the sheet as an object to which the folding processing is performed is transmitted to a drive control unit (not shown) of the folding roller drive motor 453 from the control unit of the image forming apparatus main body, and the drive control unit acquires the sheet type information. The sheet type denotes, for example, thick paper, waterproof paper, color print paper or the like (step S1).

When the folding processing starts, the folding roller drive motor 453 starts driving and waits until the sheet bundle SP is transported, and in this state, driving is performed at a speed (area A shown in FIG. 7) corresponding to the sheet type acquired by the drive control unit and suitable for specified folding accuracy (step S2).

The sheet bundle SP is transported to the position of the folding rollers 451 and 452, the blade 466 is driven to the folding position of the sheet bundle SP, and they are driven at the speed suitable for the specified folding accuracy until the blade 466 comes in contact with the sheet bundle SP (step S3). When not driven to the folding position, the blade is driven until it reaches the folding position.

In the case where it is determined that the blade 466 is driven to the folding position of the sheet bundle SP, the contacted blade 466 further advances and pushes the sheet bundle SP into between the folding rollers 451 and 452. By that, the folding rollers 451 and 452 presses a folding objective part as the head position of the sheet bundle SP, and the folding work is performed on the sheet bundle SP by the rotation of the folding rollers 451 and 452.

When the folding work on the folding objective part is ended, the folding roller drive motor 453 is driven at a speed (area B shown in FIG. 7) higher than the speed suitable for the folding accuracy (step S4). The folding processing is approximate to line contact between the sheet bundle and the folding rollers 451 and 452, and a time when the pressure of the folding processing is exerted on the sheet bundle SP is not very long. Accordingly, after it is ended instantaneously, since the sheet bundle SP is merely transported to the discharge port, when the transport is performed at a high speed, the performance of the whole sheet post-processing apparatus is improved. During this high speed driving, the folding rollers 451 and 452 transport a non-folded objective part of the sheet bundle SP.

By detecting the passage of the rear end of the sheet bundle SP by a discharge position sensor (not shown), this high speed driving is kept until the sheet bundle SP is transported to the discharge position (step S5).

When it is detected that the sheet bundle SP subjected to the folding processing reaches the discharge position, the folding roller drive motor 453 is driven at a speed suitable for keeping the paper discharge alignment (area C shown in FIG. 7), and the sheet bundle SP is discharged (step S6). The speed suitable for keeping the paper discharge alignment is, so to speak, a middle speed, and is made such a degree that the alignment of the sheet bundle SP subjected to the folding processing is not disturbed.

By detecting the passage of the rear end of the sheet bundle SP by a discharge confirmation sensor (not shown), the folding roller drive motor 453 is driven at the medium speed until the discharge of the sheet bundle SP is completed (step S7).

In the case where it is determined that the discharge of the sheet bundle SP is completed, the folding roller drive motor 453 is driven at a high speed (area D shown in FIG. 7) (step S8). The folding roller drive motor 453 has substantially no load, and when it is returned to the home position in a short time, the performance of the whole sheet post-processing apparatus is improved.

It is determined by an output signal from an encoder (not shown) provided in the folding roller drive motor 453 and an output signal of an HP sensor whether or not the folding roller drive motor 453 is driven to the home position (step S9). Based on the output signal from the encoder, in the case where the folding roller drive motor 453 is driven to the home position, end occurs. Incidentally, based on the output signal from the encoder, in the case where the folding roller drive motor 453 is not driven to the home position, the folding roller drive motor 453 is driven to the home position, and then, end occurs.

At the respective steps, it is desirable that the ratio of the drive speeds of the folding roller drive motor 453 shown in FIG. 7 is set to be approximately, for example, area A:area B:area C:area D:=60:100:80:100.

In the embodiment 1, since the folding roller drive motor 453 is controlled according to the sheet type, even if the sheet type varies, it is possible to prevent variations in the folding processing from occurring.

Embodiment 2

In this embodiment 2, the folding drive motor 453 is controlled according to a sheet size and a sheet type.

Figure 8:
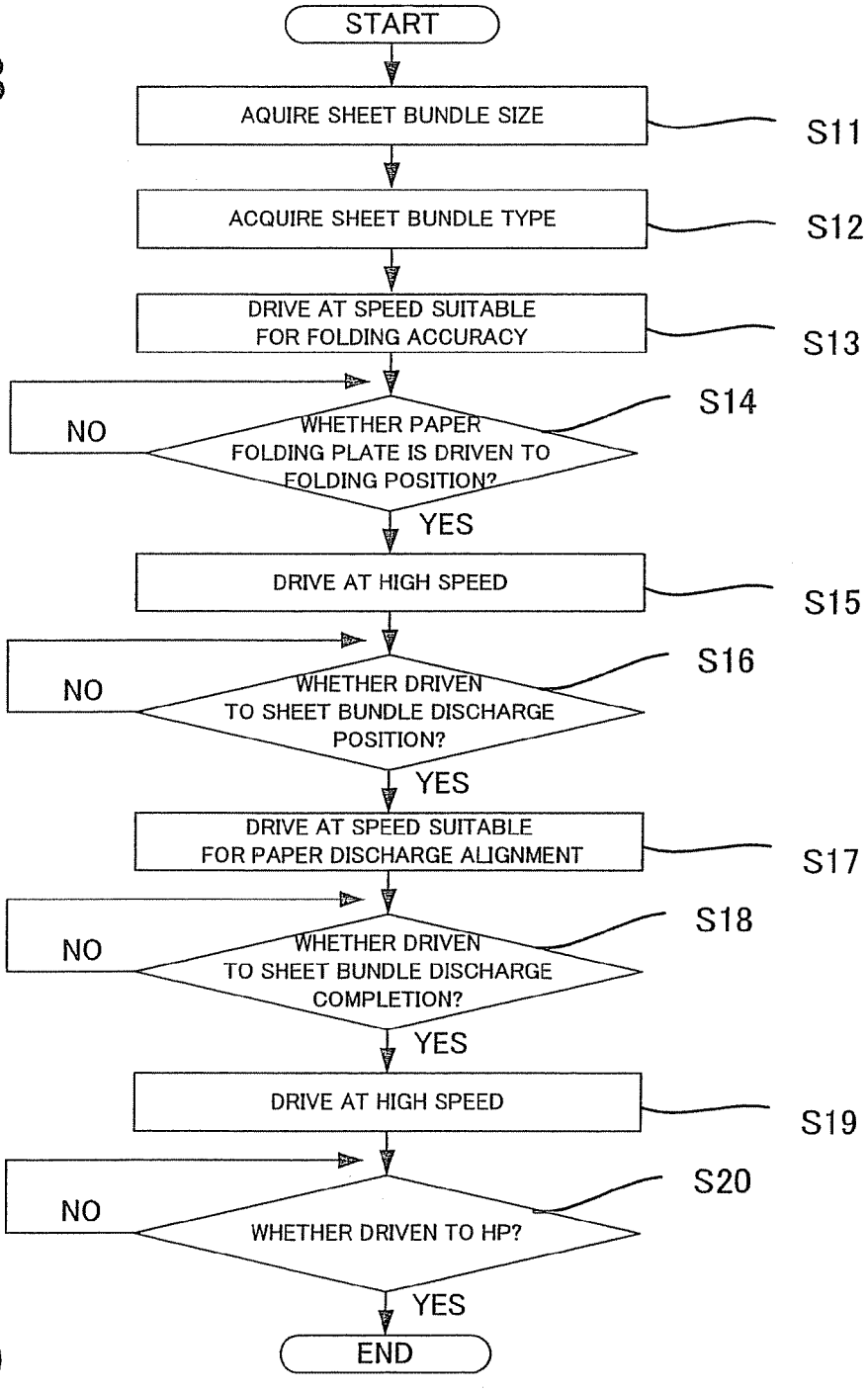
FIG. 8 is a flowchart of control of a folding roller drive motor in a sheet post-processing apparatus of embodiment 2 of the invention.
Figure 9:
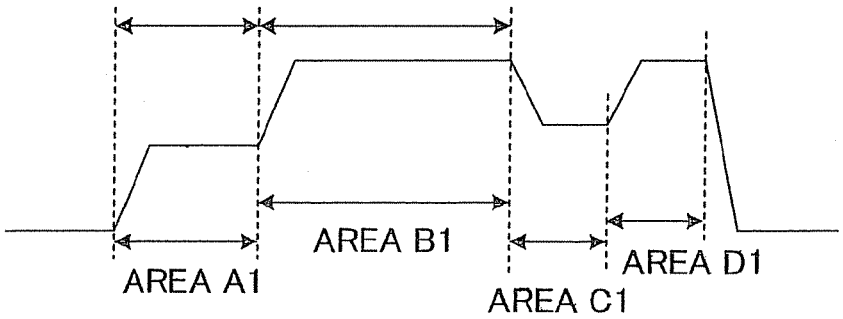
FIG. 9 is a timing chart of the folding roller drive motor in the sheet post-processing apparatus of the embodiment 2 of the invention.

FIG. 8 is a flowchart of control by PWM driving of the folding roller drive motor 453, and FIG. 9 shows a timing when a rotation speed is changed by changing a duty while the folding roller drive motor 453 is PWM driven.

First, sheet size information on the sheet as an object to which the folding processing is performed is transmitted to the drive control unit (not shown) of the folding roller drive motor 453 from the control unit of the image forming apparatus main body, and the drive control unit acquires the sheet size information. The sheet size denotes, for example, A4, A3, B5, B4 or the like according to Japanese Industrial Standards, or Letter size, Ledger size or the like in U.S. (step S11).

Next, sheet type information on the sheet as the object to which the folding processing is performed is transmitted to the drive control unit (not shown) of the folding roller drive motor 453 from the control unit of the image forming apparatus main body, and the drive control unit acquires the sheet type information. The sheet type denotes, for example, thick paper, waterproof paper, color print paper or the like (step S12).

When the folding processing starts, the folding roller drive motor 453 starts driving and waits until the sheet bundle SP is transported, and in this state, driving is performed at a speed (area A shown in FIG. 9) corresponding to the sheet size and sheet type acquired by the drive control unit and suitable for specified folding accuracy (step S13).

The sheet bundle SP is transported to the position of the folding rollers 451 and 452, the blade 466 is driven to the folding position corresponding to the sheet size and sheet type of the sheet bundle SP, and they are driven at the speed suitable for the specified folding accuracy until the blade 466 comes in contact with the sheet bundle SP (step S14). When not driven to the folding position, the blade is driven until it reaches the folding position.

In the case where it is determined that the blade 466 is driven to the folding position of the sheet bundle SP, the contacted blade 466 further advances and pushes the sheet bundle SP into between the folding rollers 451 and 452. By that, the folding rollers 451 and 452 press the folding objective part as the head position of the sheet bundle SP, and the folding work is performed on the sheet bundle SP by the rotation of the folding rollers 451 and 452.

When the folding work on the folding objective part is ended, the folding roller drive motor 453 is driven at a speed (area B shown in FIG. 9) higher than the speed suitable for the folding accuracy (step S15). The folding processing is approximate to linear contact between the sheet bundle and the folding rollers 451 and 452, and a time when the pressure of the folding processing is exerted on the sheet bundle SP is not very long. Accordingly, after it is ended instantaneously, since the sheet bundle SP is merely transported to the discharge port, when it is transported at a high speed, the performance of the whole sheet post-processing apparatus is improved. During this high speed driving, the folding rollers 451 and 452 transport a non-folded objective part of the sheet bundle SP.

By detecting the passage of the rear end of the sheet bundle SP by a discharge position sensor (not shown), this high speed driving is kept until the sheet bundle SP is transported to the discharge position corresponding to the sheet size and sheet type (step S16).

When it is detected that the sheet bundle SP subjected to the folding processing reaches the discharge position, the folding roller drive motor 453 is driven at a speed suitable for keeping the paper discharge alignment (area C shown in FIG. 9), and the sheet bundle SP is discharged (step S17). The speed suitable for keeping the paper discharge alignment is, so to speak, a middle speed, and is made such a degree that the alignment of the sheet bundle SP subjected to the folding processing is not disturbed.

By detecting the passage of the rear end of the sheet bundle SP by a discharge confirmation sensor (not shown), the folding roller drive motor 453 is driven at the middle speed until the discharge of the sheet bundle SP is completed (step S18).

In the case where it is determined that the discharge of the sheet bundle SP is completed, the folding roller drive motor 453 is driven at a high speed (area D shown in FIG. 7) (step S19) The folding roller drive motor 453 has substantially no load, and when it is returned to the home position in a short time, the performance of the whole sheet post-processing apparatus is improved.

It is determined based on an output signal from an encoder (not shown) provided in the folding roller drive motor 453 and an output signal of an HP sensor whether or not the folding roller drive motor 453 is driven to the home position (step S20). Based on the output signal from the encoder, in the case where the folding roller drive motor 453 is driven to the home position, end occurs. Incidentally, based on the output signal from the encoder, in the case where the folding roller drive motor 453 is not driven to the home position, the folding roller drive motor 453 is driven to the home position, and then, end occurs.

At the respective steps, it is desirable that the ratio of the drive speeds of the folding roller drive motor 453 shown in FIG. 9 is approximately, for example, area A:area B:area C:area D=60:100:80:100.

In the embodiment 2, since the folding roller drive motor 453 is controlled according to the sheet size and sheet type, even if the sheet size and sheet type vary, it is possible to prevent variations in the folding processing from occurring.

Embodiment 3

In this embodiment 3, the speed of the folding drive motor 453 is controlled according to the position of the blade 466 which comes in contact with the sheet bundle SP and pushes it into between the folding rollers 451 and 452.

Figure 10:
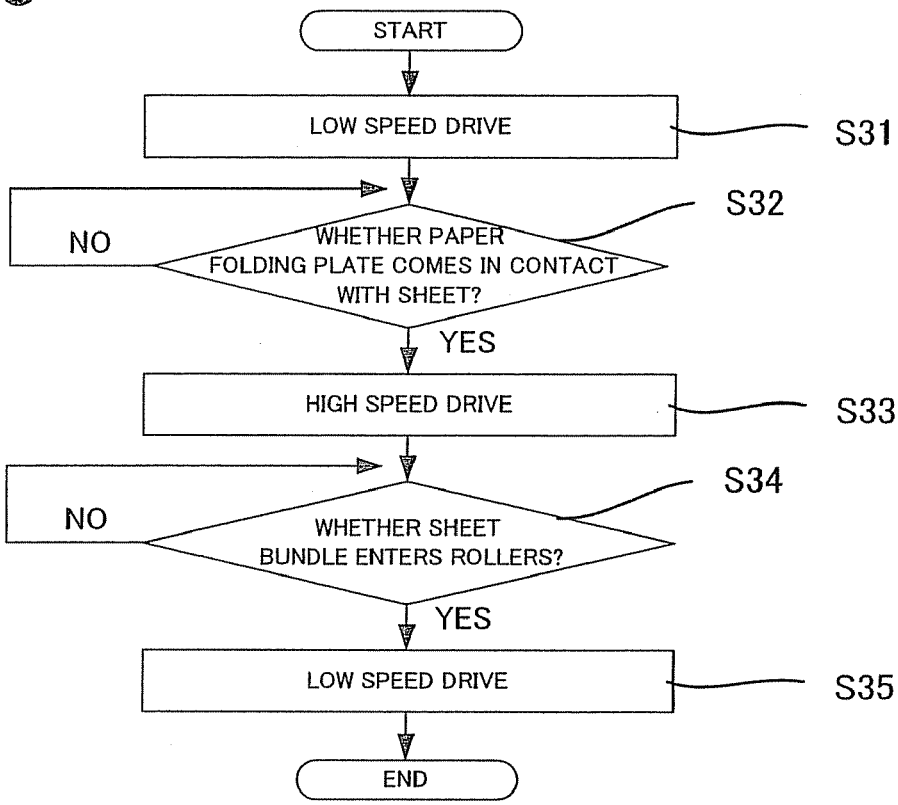
FIG. 10 is a flowchart of control of a folding roller drive motor in a sheet post-processing apparatus of embodiment 3 of the invention.
Figure 11:
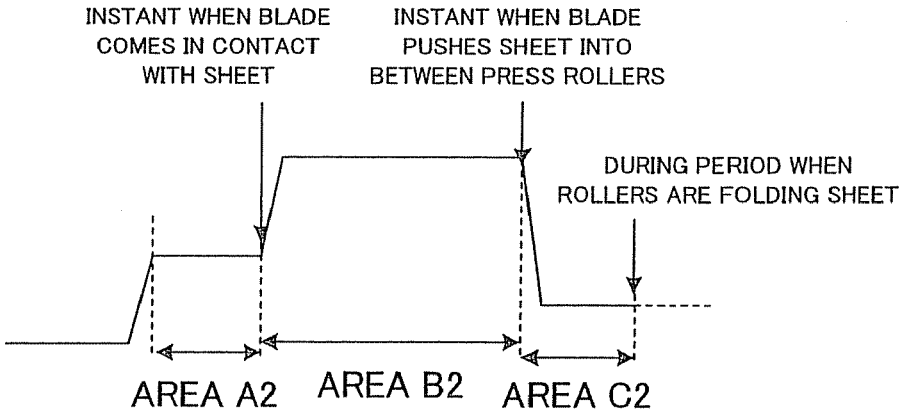
FIG. 11 is a timing chart of the folding roller drive motor in the sheet post-processing apparatus of the embodiment 3 of the invention.

FIG. 10 is a flowchart of control of the folding roller drive motor 453 by PWM driving, and FIG. 11 shows a timing when a rotation speed is changed by changing a duty while the folding roller drive motor 453 is PWM driven.

Figure 12:
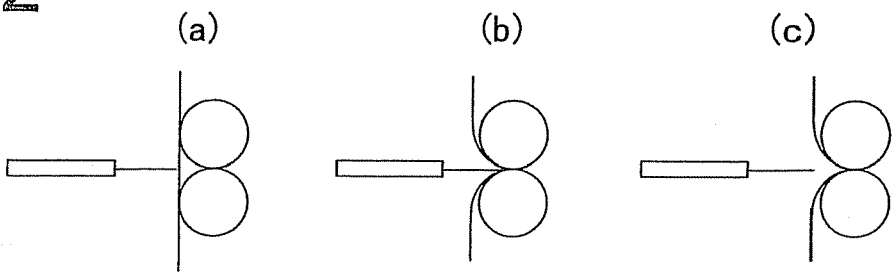
FIGS. 12(*a*) to 12(*c*) are operation explanatory views for explaining the operation of a blade in the sheet post-processing apparatus of the embodiment 3 of the invention.

First, as shown in FIG. 12(*a*), until the blade 466 comes in contact with the sheet bundle SP, the folding drive motor 453 is driven at a low speed so that no shift occurs at the instant when the blade comes in contact (step S31).

It is determined by a sensor whether or not the blade comes in contact with the sheet bundle SP. In the case where it does not in contact therewith, the folding drive motor 453 is driven at a low speed (area A2 shown in FIG. 11) until it comes in contact (step S32). This is performed to prevent the occurrence of a case in which the position where the blade comes in contact is shifted by the reaction of the contact even if an alignment is made so that the blade comes in contact with the center of the sheet bundle.

As shown in FIG. 12(*b*), after the blade 466 comes in contact with the sheet bundle SP, when the sheet bundle SP is pushed into between the folding rollers 451 and 452, the folding drive motor 453 is driven at a high speed (step S33). When the blade 466 is pushed the sheet bundle into between the rollers, since a load is very high, the inertia force by the high speed driving is used.

The sheet bundle SP pushed by the blade 466 sufficiently enters between the pressing folding rollers 451 and 452, and until the instant when the blade 466 reaches between the folding rollers 451 and 452 (area B2 shown in FIG. 11), the high speed driving is kept, and when it reaches (step S34), the blade 466 is quickly returned to the home position.

As shown in FIG. 12(*c*), when it is confirmed that the sheet bundle SP enters between the pressing folding rollers 451 and 452, in order to sufficiently deeply perform the folding processing to the folding objective part of the sheet bundle SP by the folding rollers 451 and 452, the folding drive motor 453 is again driven at a low speed (area C2 shown in FIG. 11) (step S35) The degree of the low speed here is made such that the speed is further lower than the speed in the period before the blade 466 comes in contact with the sheet bundle SP, and the accuracy of the folding processing is improved.

By controlling the folding drive motor 453 as described in the embodiment 3, the blade comes in contact with the center of the sheet bundle at the low speed, and therefore, it is possible to prevent the shift from occurring immediately after the instant when the blade 466 comes in contact with the sheet bundle SP.

Besides, since the blade 466 is driven at the low speed when the folding is performed, the folding processing can be sufficiently deeply performed to the folding objective part of the sheet bundle SP.

Incidentally, in the folding operation described in the respective embodiments, with respect to portions of the sheet bundle SP nipped between the protrusions 466*a*, 466*b* and 466*c* of the blade 466 and the folding rollers 451 and 452, since the pair of the folding rollers 451 and 452 can not be directly brought into press contact, the folding state becomes worse by the thickness of the blade 466. With respect to the folding state at the needle position, since the folding becomes worse by the thickness of the needle as compared with the place where there is no needle, and accordingly, since the protrusions 466*a* and 466*c* of the blade 466 are coincident with the needle positions of the sheet bundle SP, the position where the folding state becomes worse is coincident with the needle position, and the minimum folding state can be ensured.

Besides, in the operation in which the protrusions 466*a*, 466*b* and 466*c* of the blade 466 press the sheet bundle SP, advance to the position overlapping with the nip position of the folding rollers 451 and 452, and the folding processing is performed to the center part of the sheet bundle SP by the press contact and rotation of the folding rollers 451 and 452, it is necessary that the protrusions 466*a*, 466*b* and 466*c* of the advanced blade 466 retract from the pressurizing state of the folding rollers 451 and 452 and the sheet bundle SP, and at this time, the portions of the blade 466 nipped between the folding rollers 451 and 452 are only the protrusions 466*a*, 466*b* and 466*c*, and the area is small, and therefore, the friction force of the folding rollers 451 and 452 is small, and the load of the drive part at the time of the retraction is small.

After the drive motor of the transport rollers 232 and 211 is stopped, the rotation of the drive motor is locked, so that the leading end part of the sheet bundle SP is fixed. By locking the transport rollers 232 and 211, the fixing of the sheet bundle SP by the paper discharge guide plate 231 can be made certain.

Figure 13:
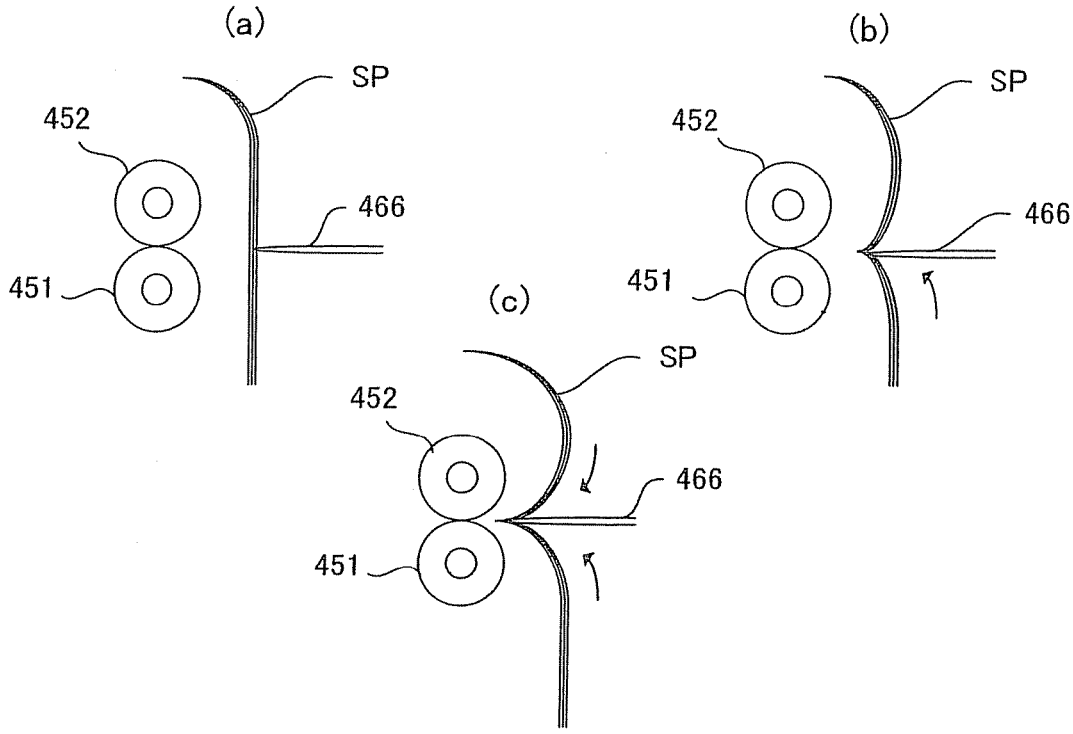
FIGS. 13(*a*) to 13(*c*) are side views showing press positions of the blade and movements of the sheet bundle at the time of the folding processing in the respective embodiments of the sheet post-processing apparatus of the invention.

Next, as shown in FIGS. 13(*a*) and 13(*b*), the sheet portion just above the staple is pushed by the blade 466, and as shown in FIG. 13(*c*), the edge part of the blade hooks the fixed needle of the sheet bundle SP and pushes it in the direction of the nip part of the folding rollers 451 and 452 while receiving resistance due to friction.

Figure 14:
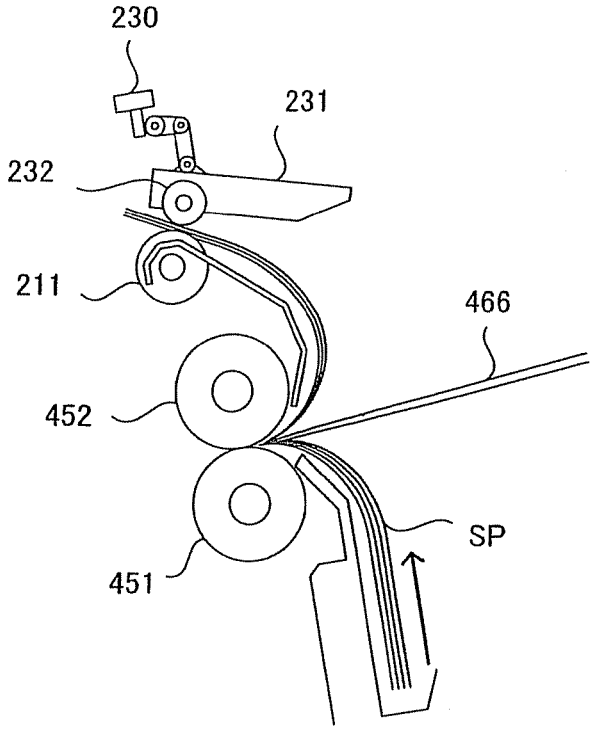
FIG. 14 is a side view showing a state at a time when the folding processing is performed while the sheet bundle is fixed by a paper discharge guide plate in the respective embodiments of the sheet post-processing apparatus of the invention.

As shown in FIG. 14, by fixing the leading end of the sheet bundle SP by using the paper discharge guide plate 231, the movement of the sheet bundle SP due to a warp produced by pushing of the blade 466 is caused only from the rear end direction of the sheet bundle SP which is not fixed, and the folding position becomes stabled. As a result, since the sheet bundle SP is pushed in the state where the staple is always in contact with the edge of the blade 466, the folding processing can be performed in which the needle position of the sheet bundle SP and the folding position are certainly coincident with each other. After the folding processing is performed to the center part of the sheet by the folding rollers 451 and 452, the sheet bundle SP is discharged from the nip part of the folding rollers 451 and 452 to the paper discharge tray 301 as it is.

As described above, according to the embodiment, the folding processing can be performed to the sheet bundle SP, the operation time of the total of the folding time according to the sheet size and sheet type and the transport time thereafter can be shortened, and the processing speed of the image forming apparatus can be improved. Besides, the folding processing can be performed even to the sheet bundle of many sheets without using a large folding drive motor.

Although exemplary embodiments of the present invention have been shown and described, it will be apparent to those having ordinary skill in the art that a number of changes, modifications, or alterations to the invention as described herein may be made, non of which depart from the spirit of the present invention. All such changes, modifications, and alterations should therefore be seen as within the scope of the present invention.

What is claimed is:

1. A sheet post-processing apparatus comprising:

stitch processing means for stitching a sheet bundle transported through a transport path at plural places along a straight line orthogonal to a transport direction with staples;

folding means provided with a pair of folding rollers disposed at a later stage of the transport path with respect to the stitch processing means and a blade to push the sheet bundle into a contact part of the pair of folding rollers;

a folding roller drive motor to drive the pair of folding rollers; and control means for acquiring sheet type information of the sheet bundle and for controlling a drive or stop operation of the folding roller drive motor according to a folding processing step of the sheet bundle, wherein the control means changes a speed of the folding roller drive motor during a period before the blade comes in contact with the sheet bundle, a speed of the folding roller drive motor during a period when the sheet bundle after folding work is being transported to a discharge port, a speed of the folding roller drive motor during a period when the sheet bundle is being discharged, and a speed of the folding roller drive motor during a period when the folding roller drive motor is being returned to a home position, in accordance with the sheet type.

2. The sheet post-processing apparatus according to claim 1, wherein during the period before the blade comes in contact with the sheet bundle, the folding roller drive motor is driven at a first speed suitable for specified folding accuracy, during the period when the sheet bundle after the folding work is being transported to the discharge port, the folding roller drive motor is driven at a second speed that is higher than the first speed, during the period when the sheet bundle is being discharged, the folding roller drive motor is driven at a third speed suitable for keeping paper discharge alignment that is higher than the first speed and lower than the second speed, and during the period when the folding roller drive motor is being returned to a home position, the folding roller drive motor is driven at a fourth speed that is higher than the first speed.

3. A sheet post-processing apparatus comprising:

stitch processing means for stitching a sheet bundle transported through a transport path at plural places along a straight line orthogonal to a transport direction with staples;

folding means provided with a pair of folding rollers disposed at a later stage of the transport path with respect to the stitch processing means and a blade to push the sheet bundle into a contact part of the pair of folding rollers;

a folding roller drive motor to drive the pair of folding rollers; and control means for acquiring sheet size information and sheet type information of the sheet bundle and for controlling a drive or stop operation of the folding roller drive motor according to a folding processing step of the sheet bundle, wherein the control means changes a speed of the folding roller drive motor during a period before the blade comes in contact with the sheet bundle, a speed of the folding roller drive motor during a period when the sheet bundle after folding work is being transported to a discharge port, a speed of the folding roller drive motor during a period when the sheet bundle is being discharged, and a speed of the folding roller drive motor during a period when the folding roller drive motor is being returned to a home position, in accordance with the sheet size and the sheet type.

4. The sheet post-processing apparatus according to claim 3, wherein during the period before the blade comes in contact with the sheet bundle, the folding roller drive motor is driven at a first speed suitable for specified folding accuracy, during the period when the sheet bundle after the folding work is being transported to the discharge port, the folding roller drive motor is driven at a second speed that is higher than the first speed, during the period when the sheet bundle is being discharged, the folding roller drive motor is driven at a third speed suitable for keeping paper discharge alignment that is higher than the first speed and lower than the second speed, and during the period when the folding roller drive motor is being returned to the home position, the folding roller driving motor is driven at a fourth speed that is higher than the first speed.

5. A sheet post-processing apparatus comprising:

stitch processing means for stitching a sheet bundle transported through a transport path at plural places along a straight line orthogonal to a transport direction with staples;

folding means provided with a pair of folding rollers disposed at a later stage of the transport path with respect to the stitch processing means and a blade to push the sheet bundle into a contact part of the pair of folding rollers;

a folding roller drive motor to drive the pair of folding rollers; and control means for controlling a drive or stop operation of the folding roller drive motor according to a folding processing step of the sheet bundle, wherein the control means changes a speed of the folding roller drive motor between a period before the blade comes in contact with the sheet bundle, a period when the blade is pushing the sheet bundle into between the folding rollers, and a period when the folding rollers are folding the sheet bundle in accordance with the sheet type, during the period before the blade comes in contact with the sheet bundle, the folding roller drive motor is driven at a first low speed, during the period when the blade is pushing the sheet bundle into between the folding rollers, the folding roller drive motor is driven at a high speed, during the period when the folding roller is folding the sheet bundle, the folding roller drive motor is driven at a second low speed, and the second low speed is lower than the first low speed.

* * * * *